US007902957B2

(12) United States Patent
Lukaszewski et al.

(10) Patent No.: US 7,902,957 B2
(45) Date of Patent: Mar. 8, 2011

(54) PHASE CHANGE COOLED ELECTRICAL RESISTOR

(75) Inventors: Richard A. Lukaszewski, New Berlin, WI (US); John R. Brubaker, Milwaukee, WI (US); Paul J. Grosskreuz, West Bend, WI (US); Neil Gollhardt, Fox Point, WI (US); Lawrence D. Radosevich, Muskego, WI (US); Bruce W. Weiss, Milwaukee, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 950 days.

(21) Appl. No.: 11/796,822

(22) Filed: Apr. 30, 2007

(65) Prior Publication Data

US 2008/0266046 A1 Oct. 30, 2008

(51) Int. Cl.
*H01C 1/08* (2006.01)

(52) U.S. Cl. ..... 338/53; 338/51; 361/700

(58) Field of Classification Search ..... 338/51, 338/59, 53, 332, 322, 327, 219; 361/700–703
See application file for complete search history.

(56) References Cited

U.S. PATENT DOCUMENTS

| | | | | |
|---|---|---|---|---|
| 4,716,396 | A * | 12/1987 | Kneifel | 338/226 |
| 5,990,780 | A * | 11/1999 | Caddock, Jr. | 338/309 |
| 6,166,937 | A * | 12/2000 | Yamamura et al. | 363/141 |
| 6,490,159 | B1 * | 12/2002 | Goenka et al. | 361/700 |
| 6,522,239 | B1 * | 2/2003 | Peschl | 338/59 |
| 6,979,843 | B2 * | 12/2005 | Nakajima et al. | 257/182 |

* cited by examiner

*Primary Examiner* — Kyung Lee
(74) *Attorney, Agent, or Firm* — Fletcher Yoder LLP; Alexander R. Kuszewski; John M. Miller

(57) ABSTRACT

A technique is disclosed for cooling resistive elements, such as brake resistors used in motor drives, as well as other resistors. A phase change heat spreader is thermally coupled to the resistive element and a continuous phase change cycle takes place in the heat spreader to extract heat from the resistive element. The element and heat spreader may be packaged as a modular unit or may be integrated into a system.

13 Claims, 2 Drawing Sheets

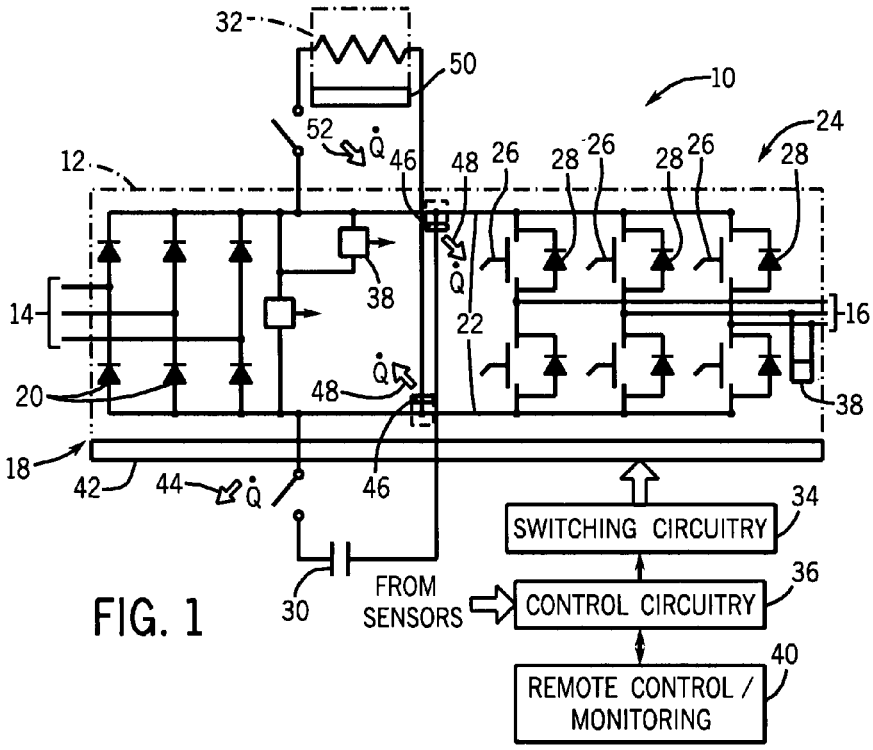
FIG. 1
FIG. 4
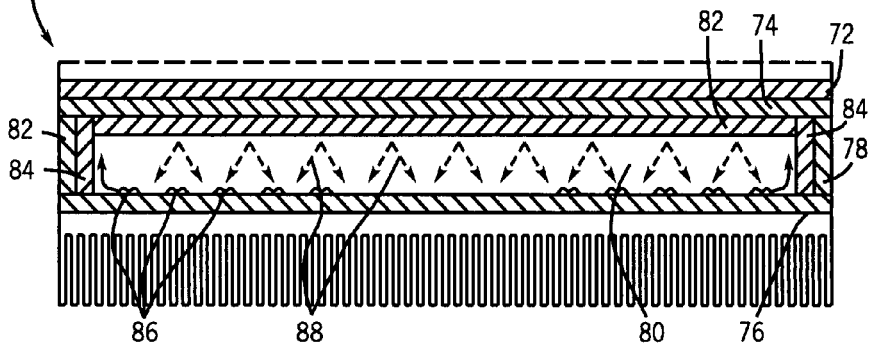

FIG. 2
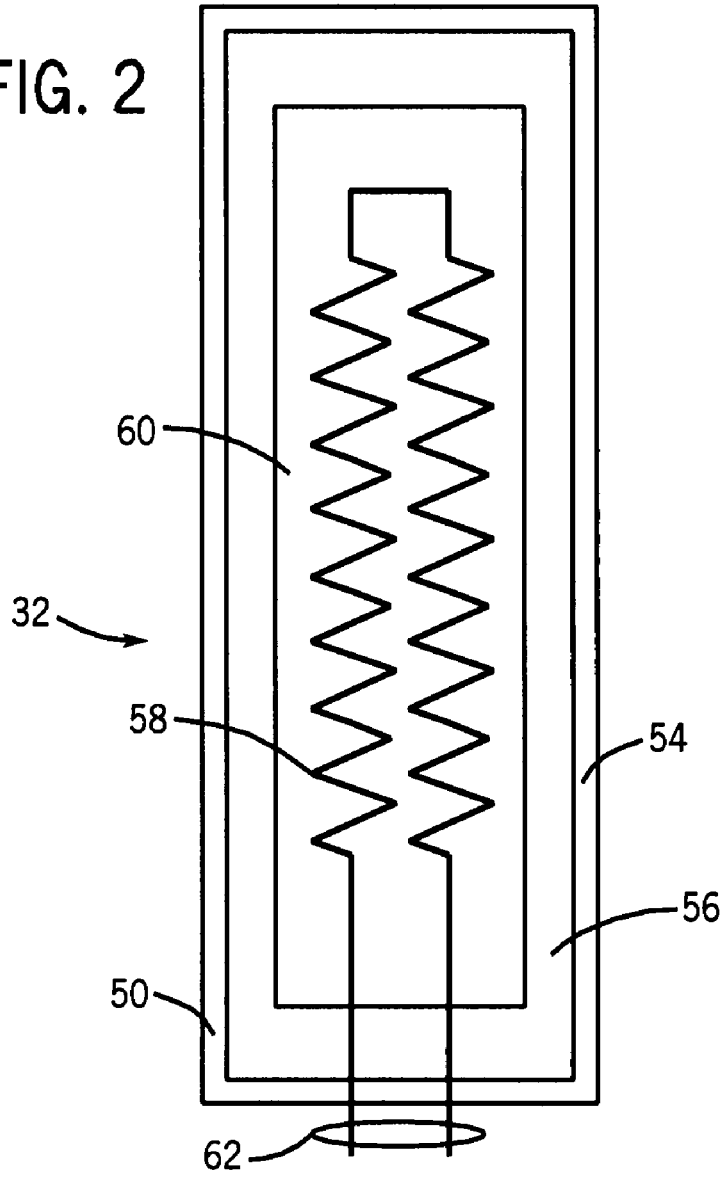
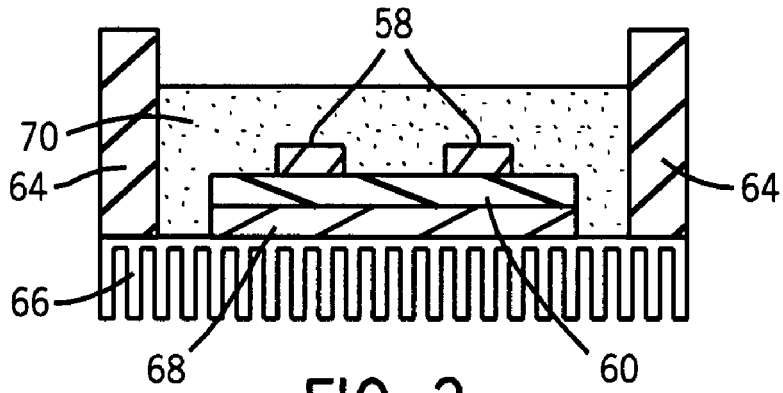
FIG. 3

PHASE CHANGE COOLED ELECTRICAL RESISTOR

BACKGROUND

The present invention relates generally to the field of thermal management structures for power electronic circuits and the like. More particularly, the invention relates to the cooling of resistors, such as brake resistors used in inverters and other power electronic devices.

Resistors are used in power electronic devices for a range of reasons. Firstly, such resistors may operatively figure as part of the overall power signal conditioning or control scheme. However, other resistors are used to dissipate energy, such as in the case of motor drives, power converters, and so forth. Such brake resistors may be associated, for example, with a DC bus extending between a rectifier and a converter (e.g., an inverter). The resistors may be switched into the circuit when necessary to dissipate energy, such as for braking an inertial load. Because resistors develop significant heat due to their internal resistance and the current flowing through them during operation, heat dissipation is often a challenge for their use.

Conventional approaches to cooling resistors, particularly brake resistors, having included the use of monolithic heat spreaders, radiant and convective thermal transfer, and transfer to a circulated cooling medium, such as water. However, in many settings, the resistors may generate more heat than can be adequately transmitted to the environment by conventional means. Water circulating systems are often undesirable due to their complexity and the potential for leaks. Many conventional cooling schemes also fail adequately to reduce temperature differences or gradients in structures surrounding the resistor.

There is a need, therefore, for improved approaches to thermal management of resistive structures, such as brake resistors. There is particular need for a technique which would allow for heat to be extracted from a brake resistor in a packaged or modular structure, and that would render the structure and the overall circuitry more isothermal than conventional arrangements.

BRIEF DESCRIPTION

The present invention provides an approach to resistive element cooling designed to respond to such needs. The approach may be used in a variety of applications and settings. It is particularly well suited to cooling large resistors from which substantial quantities of heat should be extracted. A particular setting for the approach is in cooling brake resistors, such as those used in motor drive, vehicle drive, and similar applications.

In accordance with aspects of the invention, a phase change heat spreader or cooling device is disposed adjacent to a resistor to be cooled. The resistor may take any suitable form. However, a planar resistor arrangement is particularly attractive insomuch as it may be placed in closer proximity to the heat spreader. The resistor may be placed in a modular enclosure, and the heat spreader either disposed adjacent to a side of the enclosure, or incorporated directly therein (e.g., as one side of the device. Moreover, such heat spreaders may be associated with more than one side of the enclosure.

In operation, the resistor generates heat due to current flowing through it, and heat is drawn from the resistor by a continuous phase change cycle that occurs within the phase change heat spreader. Because the phase change occurs over a large area within the heat spreader, heat within structures surrounding the resistor, such as the enclosure surfaces, is distributed more evenly, rendering the structures more isothermal.

DRAWINGS

These and other features, aspects, and advantages of the present invention will become better understood when the following detailed description is read with reference to the accompanying drawings in which like characters represent like parts throughout the drawings, wherein:

FIG. 1 is a diagrammatical overview of an exemplary power electronic circuit including a resistor cooled by a phase change heat spreader or cooling device in accordance with aspects of the invention;

FIG. 2 is diagrammatical view of an exemplary modular resistor and cooling package in accordance with aspects of the invention;

FIG. 3 is a diagrammatical sectional view of the exemplary modular resistor and cooling package of FIG. 2; and FIG. 4 is a sectional view through an exemplary phase change cooling device or heat spreader for use in cooling a resistor in accordance with an exemplary embodiment of the invention;

DETAILED DESCRIPTION

Turning now to the drawings, and referring first to FIG. 1, an exemplary power electronic circuit 10 is illustrated in which phase change heat spreaders or cooling devices are employed in accordance with aspects of the invention. In the illustrated embodiment, circuit 10 forms a power module 12, such as for a motor drive. The power module is adapted to receive three-phase power from a line side 14 and to convert the fixed frequency input power to control frequency output power delivered at a load side 16. While an inverter circuit will generally be described below as an example of an application of the present invention, it should be borne in mind throughout this discussion that the invention is not limited to this or any particular power electronic circuit. Indeed, the invention may be used in inverter applications, converter applications, AC-to-AC circuitry, AC-to-DC circuitry, DC-to-AC circuitry, and DC-to-DC circuitry. Certain of the inventive aspects may be applied in a wide range of power electronics applications, particularly where hot spots or non-isothermal conditions exist in components, in modules, in substrates, and so forth.

In the embodiment illustrated in FIG. 1, module 12 includes a rectifier 18 defined by a series of diodes 20. The diode array converts three-phase input power to DC power that is applied to a DC bus 22. An inverter circuit 24 is formed by an array of switches 26 and associated fly-back diodes 28. As will be appreciated by those skilled in the art, the switches may include any suitable power electronic devices, such as insulated gate bipolar transistors.

A range of other components may be included in the circuitry illustrated in FIG. 1. For example, a capacitive circuit 30 may be coupled across the DC bus and may be switched in and out of the circuit as needed. Similarly, the circuitry may include a choke (not shown) that may be selectively coupled across the bus. In certain arrangements, such capacitive circuitry may be permanently connected across the DC bus. Also, in the illustrated embodiment, a brake resistor module 32 is provided that may be switched in and out of connection across the DC bus, such as to dissipate energy during braking of an initial load, such as an electric motor.

Circuitry such as that illustrated in FIG. 1 will generally be associated with switching circuitry 34 which will provide the necessary control signals for the switches 26 of the inverter. Where other system topologies are provided, similar switching circuitry will typically control solid state switching components, such as silicon controlled rectifiers, and so forth. Control circuitry 36 provides control signals for regulating operation of the switching circuitry in accordance with predefined drive protocols. The switching circuitry 36 will typically receive feedback signals from a range of sensors 38, such as for sensing currents, voltages (e.g., at the DC bus, of incoming power, outgoing power, and so forth), speeds of a driven load, and so forth. Finally, remote control-monitoring circuitry 40 may be included that may be coupled to the control circuitry 36, such as via a network connection. This circuitry may allow for remote configuration, control, monitoring and the like of the power electronic circuitry, such as for coordinating operation of the load in conjunction with other loads. Such arrangements are typically found in more complex automation systems, such as for factory automation.

Certain locations, components, modules or subsystems of the power electronic circuitry 10 may make use of a phase change heat spreader or cooling device in accordance with aspects of the invention. In general, such devices may be employed to improve heat transfer from heat sources, such as switched components, un-switched components, busses and conductors, connection points, and any other source of heat. As will be appreciated by those skilled in the art, during operation many of the components of such circuitry may produce heat generally by conduction losses in the component, or between components. Such heat will generally form hot spots, which may be thought of as regions of high thermal gradient. Conventional approaches to extracting heat to reduce the temperature of such sources include extracting heat by conduction in copper or other conductive elements, circulation of air or other fluids, such a water, and so forth. The present approach makes use of phase change devices that not only improve the extraction of heat from such sources, but aid in distributing the heat to render the heat sources and neighboring areas of the circuitry more isothermal.

In the embodiment illustrated in FIG. 1, for example, an overall module cooling device 42 is illustrated diagrammatically. This cooling device may spread heat over the entire surface area of the power module 12. The heat, or heat flow, as indicated by the letter $\dot{Q}$ in the drawings, and by the arrow 44 in the case of cooling device 42, will be removed by operation of the cooling device so as to cool the module and to reduce temperature gradients in the components and in the module itself. That is, the cooling device promotes a more isothermal distribution of temperatures, evening heating and allowing more heat to be extracted by virtue of such temperature distribution. Details for exemplary construction of the phase change cooling device are provided below. Other locations of similar cooling devices may include at or adjacent to busses or connections, as indicated by reference numeral 46 in FIG. 1, to enhance the heat flow 48 from such locations, and to render these locations more isothermal with surrounding structures. Also illustrated in FIG. 1, separate components, such as braking resistor module 32 may also be associated with similar cooling devices 50 so as to enhance heat flow from these separate devices as indicated by reference numeral 52.

A phase change heat spreader or cooling device, in accordance with the present invention, is used to extract heat from one or more resistive devices, such as brake resistors of the type discussed above with reference to FIG. 1. Again, as will be appreciated by those skilled in the art, such brake resistors may be utilized to dissipate energy during certain periods of operation of the circuitry, such as for braking inertial loads. An exemplary implementation of a phase change heat spreader in conjunction with a modularized brake resistor is illustrated in FIGS. 2 and 3.

As shown in FIG. 2, and accordance with a presently contemplated embodiment, a brake resistor 32 is associated with a phase change heat spreader or cooling device 50. The arrangement may be modularized to facilitate fabrication, implementation, and extraction of heat from the resistive element. In the embodiment illustrated in FIG. 2, for example, an enclosure 54 is defined to at least partially surround an internal volume 56 in which a brake resistor 58 is disposed. The resistor may be made of any suitable material, as may the enclosure. For example, the resistor may be made of a ceramic material, a metallic material, and so forth. Moreover, the resistive element may include one or an assembly of elements which may be disposed in a generally planar fashion within the enclosure. Although the invention is not limited to such planar resistive elements, maintaining relatively close contact between the resistive element and the phase change heat spreader will aid in extracting heat from the resistive element during operation, and more evenly spread the heat to obtain a more isothermal package. Two or more leads 62 will extend from the enclosure, and these may be formed as terminals, for electrically coupling the resistive element to circuitry with which it cooperates in operation.

FIG. 3 is a diagrammatical elevational view of an exemplary modular resistive element with an associated phase change heat spreader. As noted above, the arrangement includes a resistive element 58 which is disposed in a generally planar fashion within an enclosure. In the embodiment illustrated in FIG. 3, the enclosure is formed by side members 64 that meet and sealingly join a base 66. The base 66 itself, in this contemplated embodiment, forms part of the phase change heat spreader to extract heat from the resistive element. In other implementations, a base or substrate may be provided in the enclosure, and the phase change heat spreader may be thermally bonded to this base.

Within the enclosure, the resistive element 58 is disposed on a dielectric material or insulator 60. The insulator is, in turn, thermally bonded to the base 66, such as by means of a solder, thermal grease or the like. The leads of the resistive element 58 (see, FIG. 2) are routed out of the enclosure, such as through an end (not shown in FIG. 3). A potting material or silicon gel may then be used to fill the enclosure at least partially, and to cover the resistive element as indicated by reference numeral 70. The package may, where desired, be closed by top member (not shown in the figures) that covers the potting material or gel. In certain embodiments, particularly where epoxy potting materials are employed that provide sufficient protection of the internal components, such a cover may be eliminated.

In operation, the resistive element may be switched in and out of the circuit as desired, and dissipates energy through resistive losses. The resulting energy is easily transmitted through the insulating layer 60 and thermal bonding layer 68 to the phase change heat spreader or cooling device 66. While locations immediately below the resistive element will typically be hotter than other locations in the enclosure, the phase change heat spreader will aid in distributing this heat over a larger area, rendering the entire device more isothermal, and lowering the overall operating temperature.

The present technique is thus based upon the use of a phase change cooling device which can be closely associated with or integrated into a package with the resistive element. The resistive element itself may be generally conventional in structure or, as discussed above, may be designed specifically to provide a more planar profile for packaging. It should be noted that similar phase change heat spreaders may be disposed adjacent to multiple sides of the enclosure in which the resistive element is positioned. On the one or more sides from which heat is to be dissipated, the phase change cooling device or devices allow for evaporation and recondensation of an internal cooling fluid. The change in phase extracts heat from the resistive element package. The cooling device may extend over an expanded area of the package to render the overall package more isothermal than conventional devices. The resulting heat extraction reduces the temperature of the package, and particularly the maximum temperature reached by the resistive element, allowing for extended life, high power ratings, and higher power density.

It should be noted that various alternative packaging arrangements may be designed for cooling resistive elements. For example, in the foregoing arrangement, the resistive element is disposed at least partially in an enclosure. Such enclosures may be preferred to reduce the exposure of the elements to the environment and to personnel. Alternatively one or more resistive elements may be similarly completely encased in an enclosure. Still further, cooled resistive structures may be designed that are not individually enclosed, but that are placed in a housing or enclosure with other components, such as in a converter or drive package.

It should also be noted that in the embodiment described above, and in various presently contemplated alternative arrangements, the "base" of the structure is not intended to be limited. That is, the base on which the resistive element is ultimately disposed (e.g., with or without intervening layers or materials) may be an integral part of an enclosure. However, this need not be the case. More generally, the base is simply one or more underlying structures between the resistive element and the phase change heat spreader. The base itself may even be part of the heat spreader itself, such as the evaporator plate of the arrangement described below with respect to FIG. 4.

An exemplary phase change heat spreader is illustrated in section in FIG. 4. As shown in FIG. 4, an exemplary cooling device 50 suitable for use in the embodiments of the invention will typically be positioned immediately adjacent to a hot substrate or device layer 72, which may be the base of an enclosure or other surface on which a resistive element is placed. The substrate 72 is to be cooled. Ultimately, as described below, the underlying structures reduce thermal gradients and more evenly distribute heat for improved heat extraction. The cooling device 50, itself, is formed of an evaporator plate 74 disposed in facing relation and space from a condenser plate 76. Sides 78 extend between the plates to hold the plates in a fixed mutual relation and to sealingly close an internal volume 80. A primary wick structure 82 is disposed immediately adjacent to the evaporator plate 74, and secondary wick structures 84 extend between the condenser plate 76 and the primary wick structure. It should be noted that another section of the secondary wick structure (not shown in the figures) may extend over all or a portion of the condenser plate.

The various materials of construction for a suitable phase change cooling device may vary by application, but will generally include materials that exhibit excellent thermal transfer properties, such as copper and its alloys. The wick structures may be formed of a similar material, and provide spaces, interstices or sufficient porosity to permit condensate to be drawn through the wick structures and brought into proximity of the evaporator plate. Presently contemplated materials include metal meshes, sintered metals, such as copper, and so forth. In operation, a cooling fluid, such as water, is sealingly contained in the inner volume 80 of the device and the partial pressure reigning in the internal volume allows for evaporation of the cooling fluid from the primary wick structure due to heating of the evaporator plate. Vapor released by the resulting phase change will condense on the secondary wick structure and the condenser plate, resulting in significant release of heat to the condenser plate. To complete the cycle, the condensate, indicated generally by reference numeral 86 in FIG. 4, will eventually reach the secondary wick structures through which it will be transferred to the primary wick structure to be re-vaporized as indicated by reference numeral 88. A continuous thermal cycle of evaporation and condensation is thus developed to effectively cool the evaporator plate and transfer heat to the condenser plate. Because the evaporator plate extends over areas of hot spots, and beyond the hot spots to adjacent areas, and because evaporation takes place over this extended area by virtue of the primary wick structure, heat is more evenly distributed over the surface area of the condenser plate, and hence the hot substrate 72, than in conventional heat sink structures.

It should be noted that, as mentioned above, and in further embodiments described below, the phase change heat spreader may be designed as an "add-on" device, or may be integrated into the design of the resistive element module (typically as a support or substrate). Similarly, the fins on the various structures may be integral to the heat spreader, such as with the condenser plate. Also, the cooling media used within the heat spreader may include various suitable fluids, and water-based fluids are one example only. Finally, the ultimate heat removal, such as via the fins or other heat dissipating structures, may be to gasses, liquids, or both, through natural of forced convection, or a combination of such heat transfer modes. More generally, the fins described herein represent one form of heat dissipation structure, while others may be used instead or in conjunction with such fins.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An electrical resistor assembly comprising:

an electrical resistor; and a phase change heat spreader disposed adjacent to the resistor and configured to draw heat from the resistor during operation via phase changes in a cooling medium within the phase change heat spreader.

2. The electrical resistor assembly of claim 1, wherein the resistor is disposed in an enclosure and thermally coupled to the phase change heat spreader through a base of the enclosure.

3. The electrical resistor assembly of claim 2, wherein base of the enclosure forms part of the phase change heat spreader.

4. The electrical resistor assembly of claim 2, wherein the resistor includes leads extending through a side of the enclosure.

5. The electrical resistor assembly of claim 1, wherein the resistor is generally planar and extends generally parallel to the phase change heat spreader.

6. The electrical resistor assembly of claim 1, wherein the phase change heat spreader includes a generally planar evaporator side adjacent to the resistor, a wick structure for channeling condensate to the evaporator side, a generally planar condenser side opposite the evaporator side, and the cooling medium sealed between the evaporator side and the condenser side at a partial pressure that permits evaporation and condensation of the cooling medium during operation.

7. The electrical resistor assembly of claim 6, wherein the wick structure includes a primary wick structure disposed adjacent to the evaporator side and a secondary wick structure extending from the condenser side to the primary wick structure for wicking the cooling medium from the condenser to the primary wick structure.

8. The electrical resistor assembly of claim 1, comprising a heat dissipating structure thermally coupled to the phase change heat spreader to dissipate heat transferred to the heat spreader during operation.

9. A method for making an electrical resistor assembly comprising:

disposing an electrical resistor in an enclosure; and disposing a phase change heat spreader adjacent to the enclosure, the phase change heat spreader being configured to draw heat from the resistor during operation via phase changes in a cooling medium within the phase change heat spreader.

10. The method of claim 9, comprising extending leads from the resistor through a side of the enclosure.

11. The method of claim 9, comprising disposing a dielectric material between the resistor and the phase change heat spreader.

12. The method of claim 9, wherein the resistor and the phase change heat spreader are generally planar, and the phase change heat spreader is disposed generally parallel to the resistor.

13. The method of claim 9, comprising at least partially filing the enclosure with a potting material to cover the resistor.

* * * * *